US008320803B2

(12) United States Patent
Shinozaki et al.

(10) Patent No.: US 8,320,803 B2
(45) Date of Patent: Nov. 27, 2012

(54) DEVELOPING DEVICE AND CARTRIDGE

(75) Inventors: Satoshi Shinozaki, Numazu (JP); Daisuke Baba, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 188 days.

(21) Appl. No.: 12/850,014

(22) Filed: Aug. 4, 2010

(65) Prior Publication Data

US 2011/0033210 A1 Feb. 10, 2011

(30) Foreign Application Priority Data

Aug. 6, 2009 (JP) ..... 2009-183064

(51) Int. Cl.
*G03G 15/08* (2006.01)
*G03G 15/09* (2006.01)

(52) U.S. Cl. ..... 399/272; 399/281

(58) Field of Classification Search ..... 399/272, 399/281

See application file for complete search history.

(56) References Cited

U.S. PATENT DOCUMENTS 5,995,791 A * 11/1999 Kawasaki ..... 399/281
6,308,037 B1 * 10/2001 Yamashita ..... 399/272
6,343,201 B1 * 1/2002 Wada et al. ..... 399/281
7,529,503 B2 * 5/2009 Miyakawa et al. ..... 399/111

FOREIGN PATENT DOCUMENTS

JP 05-158331 A * 6/1993
JP 2005-234085 A 9/2005
JP 2007-298755 A 11/2007

* cited by examiner

*Primary Examiner* — Sophia S Chen
(74) *Attorney, Agent, or Firm* — Fitzpatrick, Cella, Harper & Scinto

(57) ABSTRACT

A developing device includes a developing container for accommodating a developer; a developer carrying member, provided rotatably in the developing container, for carrying and feeding the developer to develop an electrostatic image; a developer feeding member, including an elastic feeding portion and being rotatably provided in the developing container, for feeding the developer in the developing container toward the developer carrying member; and a circulation changing member for changing circulation of the developer in the neighborhood of the developer carrying member. In a plane perpendicular to a rotational axis of the developer carrying member, the circulation changing member is provided in a maximum rotation area of the developer feeding member so as to create a gap between itself and an entire inner surface of the developing container and a gap between itself and the developer carrying member.

11 Claims, 6 Drawing Sheets

DEVELOPING DEVICE AND CARTRIDGE

FIELD OF THE INVENTION AND RELATED ART

The present invention relates to a developing device and a cartridge.

In an image forming apparatus of an electrophotographic type, in order to faithfully reproduce an electrostatic latent image (electrostatic image) on a photosensitive member, a jumping developing method is used as one of developing methods using toner which is one component magnetic developer. In this jumping developing method, first, a developing sleeve as a developer carrying member is disposed opposed to the photosensitive member while keeping a certain gap (50-500 μm). Then, a developing bias in the form of a DC voltage biased with an AC voltage is applied to the developing sleeve, so that an electric field for reciprocating toner particles is generated. By this electric field, the toner applied onto the developing sleeve in a thin layer is jumped and deposited on the electrostatic latent image formed on the photosensitive member, so that the latent image is reversely developer into a toner image, thus being visualized.

In the jumping developing method, triboelectrically charged toner is moved onto the photosensitive member by a force of the electric field and therefore in order to faithfully reproduce the latent image, uniform charging of the toner is important. As one of means for uniformly charging the toner, as shown in FIG. 6(*a*), a constitution in which a developing blade 442 as a developer layer thickness regulating member is caused to contact a developing sleeve 441 in a counter direction with respect to a rotational direction (indicated by an arrow R2) has been known. In this constitution, as shown in FIG. 6(*b*), between a portion extending from an end of a nip N between the developing blade 442 and the developing sleeve 441 to a free end of the developing blade 442 (hereinafter, this portion is referred to as an "NE portion") and the surface of the developing sleeve 441, a minute wedge portion is created. For that reason, with respect to the toner fed toward the developing sleeve 414, most of the toner cannot enter the NE portion until the toner reaches the nip N between the developing blade 442 and the developing sleeve 441, so that a small amount of the toner is caused to pass through the nip N. Therefore, in the case where the developing blade 442 contacting counterdirectionally the developing sleeve 441 with respect to the rotational direction of the developing sleeve 441 is used, there is an advantage that thin layer coating of the toner can be realized at a low pressure. However, in this constitution, a negative ghost attributable to development occurs in some cases. As one of methods for remedying this negative ghost attributable to development, a constitution in which the negative ghost is remedied by using a circulation changing member 401 which is a member for changing circulation of the toner in the neighborhood of the developing sleeve in a developing container has been proposed (Japanese Laid-Open Patent Application (JP-A) 2007-298755).

FIG. 6(*a*) shows a state of the toner circulation using the circulation changing member 401 in the developing container. In the developing container in which the circulation changing member 401 is disposed, a part of the toner moved outside the developing blade at the NE portion of the developing blade 442 (FIG. 6(*b*)) is circulated between the developing sleeve 441 and the circulation changing member 401 in a direction indicated by an arrow M1. As a result, in the neighborhood of the developing sleeve 441, the charged toner having a mirror force is increased in amount. For that reason, compared with the case where there is no circulation changing member, a difference between a toner coating amount on the developing sleeve immediately before the latent image is developed by first rotation of the developing sleeve 441 and that immediately before the latent image is developed by second rotation performed immediately after the first rotation is small. As a result, it becomes possible to suppress the occurrence of the negative ghost. At the same time, the toner is circulated in a direction (indicated by an arrow M2) in which the toner between the circulation changing member 401 and the developing sleeve 441 is pushed up above the circulation changing member 401 although a speed thereof is slow. As a result, it is possible to prevent the same toner from circulating between the developing sleeve 441 and the circulation changing member 401 for a long time in the arrow M1 direction, so that toner deterioration can be suppressed.

However, even in the developing device using the circulation changing member, when an image is formed (printed) until the time when the toner in the developing container is consumed and decreased in amount to approach the end of its use, a resultant image density is lowered in some cases. This tendency is more noticeable in a high temperature/high humidity environment rather than in a normal temperature/normal humidity environment.

More specifically, generally, in the high temperature/high humidity environment in which the temperature and humidity are higher than those in the normal temperature/normal humidity environment, there is a tendency that flowability of the toner is low even when the image is not formed.

When the image is formed until the time when the toner in the developing container is consumed and decreased in amount to approach the end of its use, the toner in the developing container passes through the NE portion of the developing blade many times and thus is subjected to stress, so that there is a tendency that an external additive of the toner is buried in a base material of the toner. For that reason, the toner in the developing container is lowered in flowability with a smaller amount of the toner by consumption, thus being deteriorated. Particularly, in the high temperature/high humidity environment higher in temperature and humidity than those in the normal temperature/normal humidity environment, compared with the case of the normal temperature/normal humidity environment, the external additive is liable to be buried in the base material of the toner. For that reason, the toner in the developing container is further lowered in flowability and is deteriorated when compared with the case of the normal temperature/normal humidity environment.

Thus, when the toner in the developing container is consumed and decreased in amount, the toner is present only in the neighborhood of the developing sleeve, so that the flowability of the toner is lowered as described above. For that reason, the circulation of the toner toward the arrow M2 direction is slowed down, so that the same toner is repetitively subjected to rubbing for a long time by the circulation in the arrow M1 direction. As a result, the external additive is further buried in the base material of the toner is caught in a vicious cycle of further acceleration of the lowering in toner flowability and the toner deterioration, so that the image density is lowered.

SUMMARY OF THE INVENTION

A principal object of the present invention is to suppress a lowering in image density even in the case where an amount of developer in a developing container is decreased and flowability of the developer is lowered.

Another object of the present invention is to provide a developing device and a cartridge which are capable of suppressing the lowering in image density described above.

According to an aspect of the present invention, there is provided a developing device comprising:

a developing container for accommodating a developer;

a developer carrying member, provided rotatably in the developing container, for carrying and feeding the developer to develop an electrostatic image;

a developer feeding member, including an elastic feeding portion and being rotatably provided in the developing container, for feeding the developer in the developing container toward the developer carrying member; and a circulation changing member for changing circulation of the developer in the neighborhood of the developer carrying member, wherein in a plane perpendicular to a rotational axis of the developer carrying member, the circulation changing member being provided in a maximum rotation area of the developer feeding member so as to create a gap between itself and an entire inner surface of the developing container and a gap between itself and the developer carrying member.

According to another aspect of the present invention, there is provided a cartridge detachably mountable to a main assembly of an image forming apparatus, the cartridge comprising:

a developing container for accommodating a developer;

a developer carrying member, provided rotatably in the developing container, for carrying and feeding the developer to develop an electrostatic image;

a developer feeding member, including an elastic feeding portion and being rotatably provided in the developing container, for feeding the developer in the developing container toward the developer carrying member; and a circulation changing member for changing circulation of the developer in the neighborhood of the developer carrying member, wherein in a plane perpendicular to a rotational axis of the developer carrying member, the circulation changing member being provided in a maximum rotation area of the developer feeding member so as to create a gap between itself and an entire inner surface of the developing container and a gap between itself and the developer carrying member.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Figure 1:
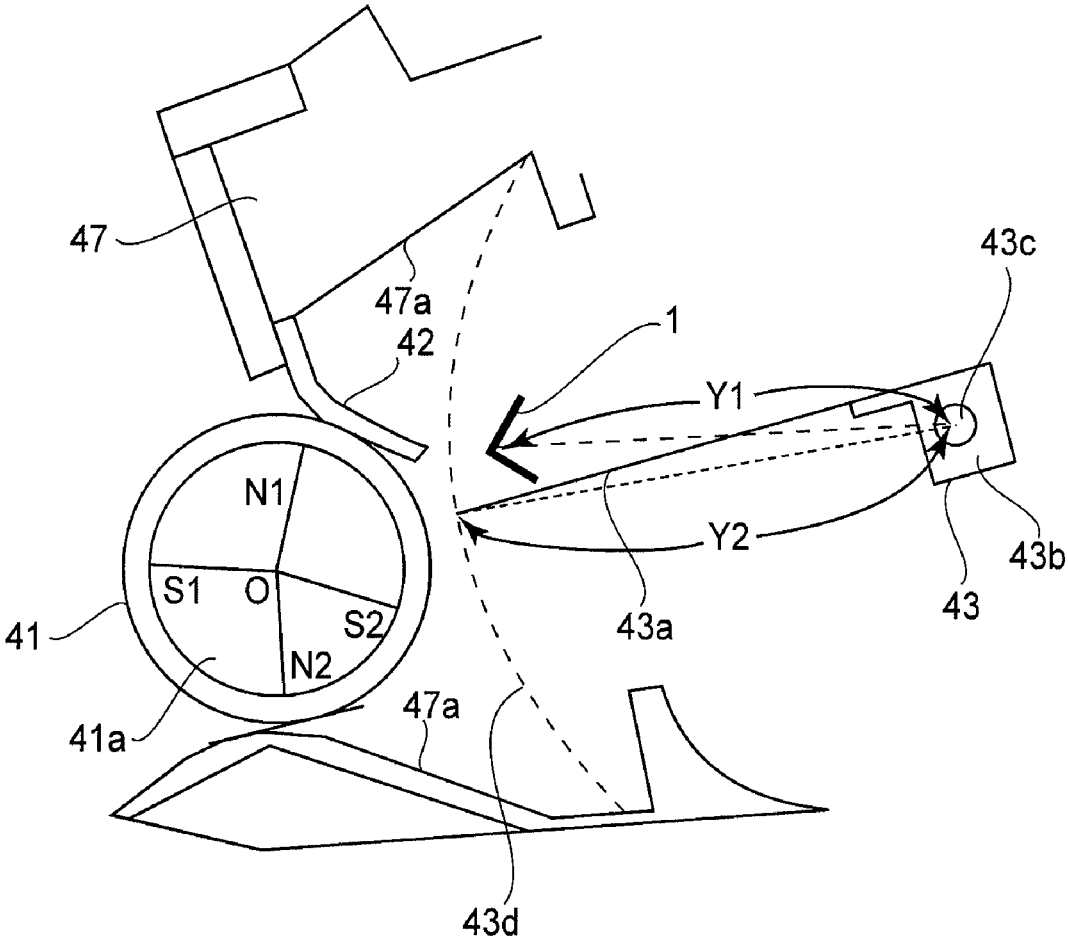
FIGS. 1 and 2 are partial sectional views of a developing device according to the present invention.

Hereinbelow, embodiments of the present invention will be described specifically with reference to the drawings. In the following embodiments, dimensions, materials, shapes and relative arrangement of constituent parts may be appropriately changed depending on constitution and various conditions of a developing device to which the present invention is applied and therefore the present invention is not limited thereto.

A cartridge including the developing device and an electrophotographic image forming apparatus in which the cartridge is detachably mounted will be described below.

Here, the electrophotographic image forming apparatus forms an image on a recording material (medium) by using an electrophotographic image forming process. Examples of the electrophotographic image forming, apparatus may include an electrophotographic copying machines, electrophotographic printers (e.g., a laser beam printer, an LED printer, etc.), facsimile machines, and word processors.

Further, the recording material is a medium on which the image is to be formed by the electrophotographic image forming apparatus and includes, e.g., paper, an OHP sheet, and the like.

Further, the cartridge is, e.g., a process cartridge or a developing cartridge which are detachably mountable to a main assembly of the electrophotographic image forming apparatus and contributes to the image forming process for forming the image on the recording material. Here, the process cartridge refers to a cartridge which is prepared by integrally supporting at least a developing means as process means and an electrophotographic photosensitive drum as an image bearing member and which is detachably mountable to the main assembly of the electrophotographic image forming apparatus. The process cartridge may include cartridges which are prepared by integrally supporting the electrophotographic photosensitive drum and a developing means and/or a cleaning means as the process means, in addition to the developing means as the process means, and which are detachably mountable to the main assembly. Incidentally, the process cartridge integrally including the electrophotographic photosensitive drum and the developing means is referred to as a so-called integral type. Further, the process cartridge integrally including the electrophotographic photosensitive drum and the process means other than the developing means is referred to as a so-called separation type.

The process cartridge can be mounted to and demounted from the main assembly of the image forming apparatus by a user himself (herself). For that reason, it is possible to easily perform maintenance of the apparatus main assembly. Incidentally, the process means act on the electrophotographic photosensitive drum.

Further, the developing cartridge includes a developing sleeve as a developer carrying member and accommodates a developer (toner) used for developing an electrostatic image formed on the electrophotographic photosensitive drum. The developing cartridge is detachably mountable to the main assembly. In the case of the developing cartridge, the electrophotographic photosensitive drum is mounted to the main assembly of the image forming apparatus or mounted to the separation type process cartridge described above which does not include the developing means. Incidentally, the developing cartridge is also detachably mountable to the image forming apparatus main assembly by the user himself (herself), so that the maintenance of the main assembly can be performed easily.

In the present invention, the cartridge includes both of the process cartridges of the integral type and the separation type. Further, the cartridge may also include the case where the separation type process cartridge and the developing cartridge are paired with each other. Further, the cartridge may also include,the case where the electrophotographic photosensitive drum is fixedly provided in the main assembly and the developing cartridge is detachably used so as to be actable on the electrophotographic photosensitive drum.

First Embodiment (General Structure of Image Forming Apparatus)

Figure 5:
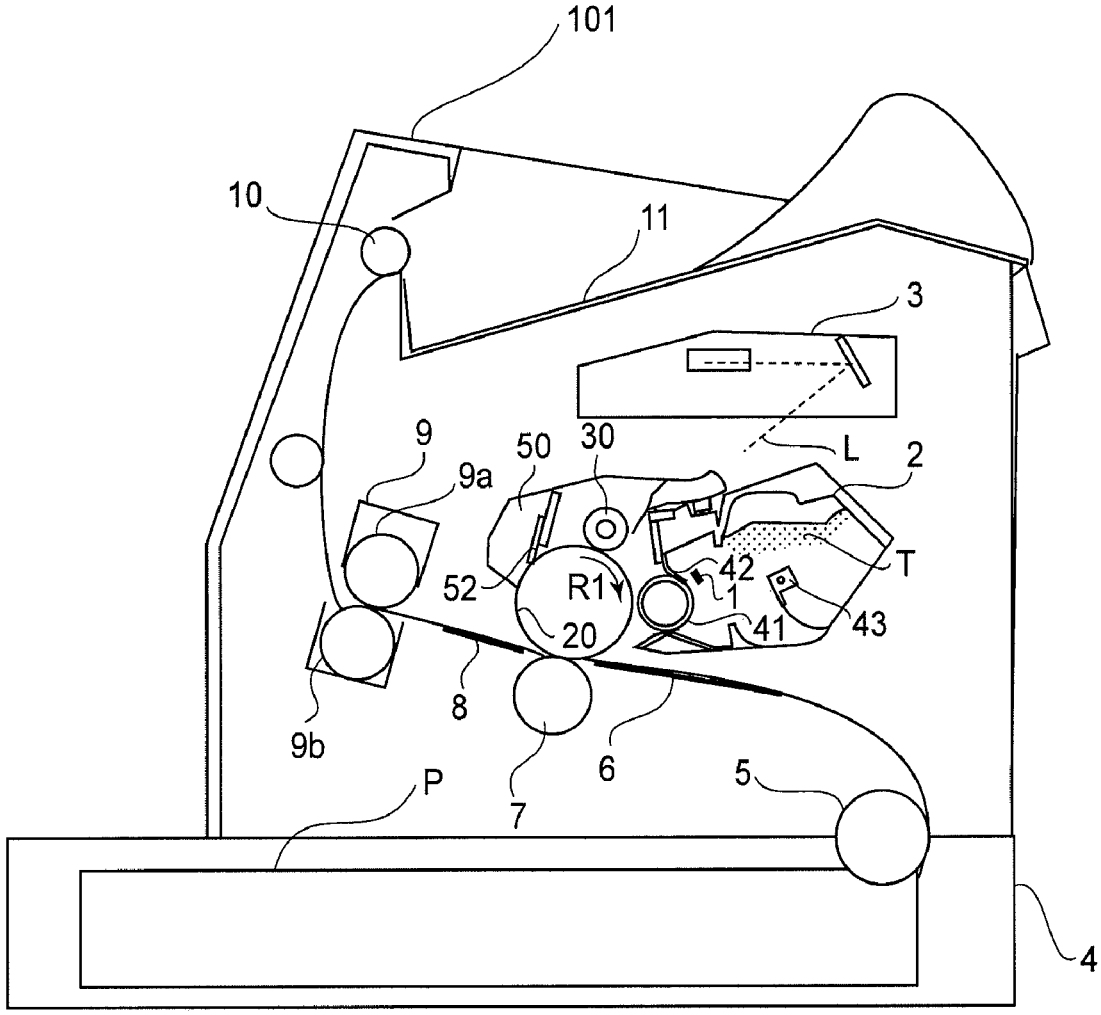
FIG. 5 is a sectional view of an image forming apparatus in the present invention.
Figure 6:
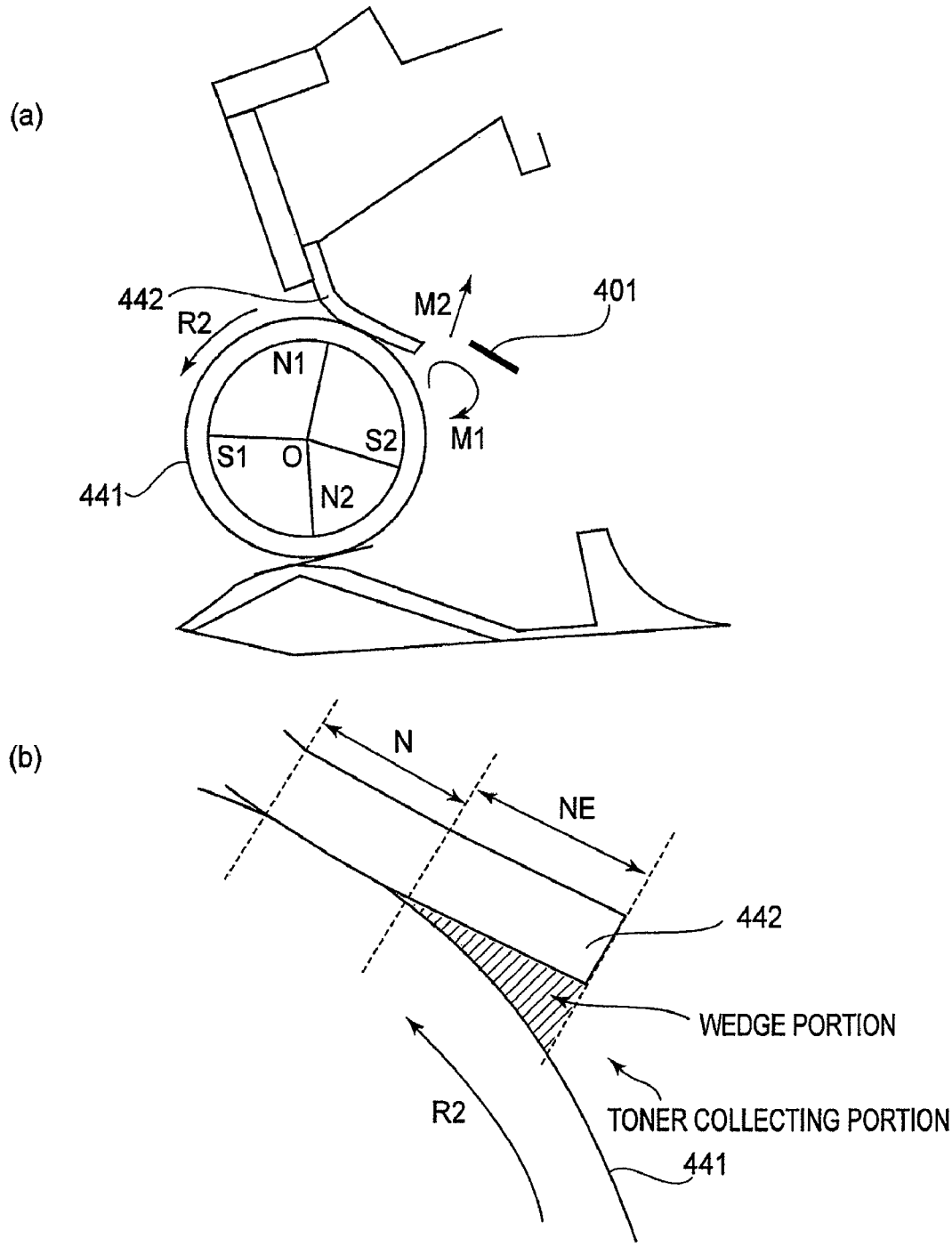
FIG.6 PRIOR ART
FIG. 6(*a*) is a partial sectional view of a conventional developing device, and FIG. 6(*b*) is an enlarged view of a developing blade in the conventional developing device.

First, with reference to FIG. 5, a general structure of the image forming apparatus will be briefly described. FIG. 5 is a schematic sectional view of the image forming apparatus.

Referring to FIG. 5, the image forming apparatus is a laser beam printer utilizing an electrophotographic technique, in which a process cartridge 2 is detachably mountable to an image forming apparatus main assembly 101.

When the process cartridge 2 is mounted into the main assembly 101, an exposure device (laser scanner unit) 3 is disposed above the process cartridge 2. Further, below the process cartridge 2, a sheet tray 4 accommodating sheets P as the recording material subjected to image formation.

Further, the main assembly 101 includes a pick-up roller 5, a sheet feeding roller. (not shown), a sheet conveying roller pair (not shown), a transfer guide 6, a transfer charging roller 7, a conveying guide 8, a fixing device 9, a sheet discharging roller pair 10, a sheet discharging tray 11, and the like along a conveying direction of the sheet P.

(Structure of Process Cartridge)

Figure 3:
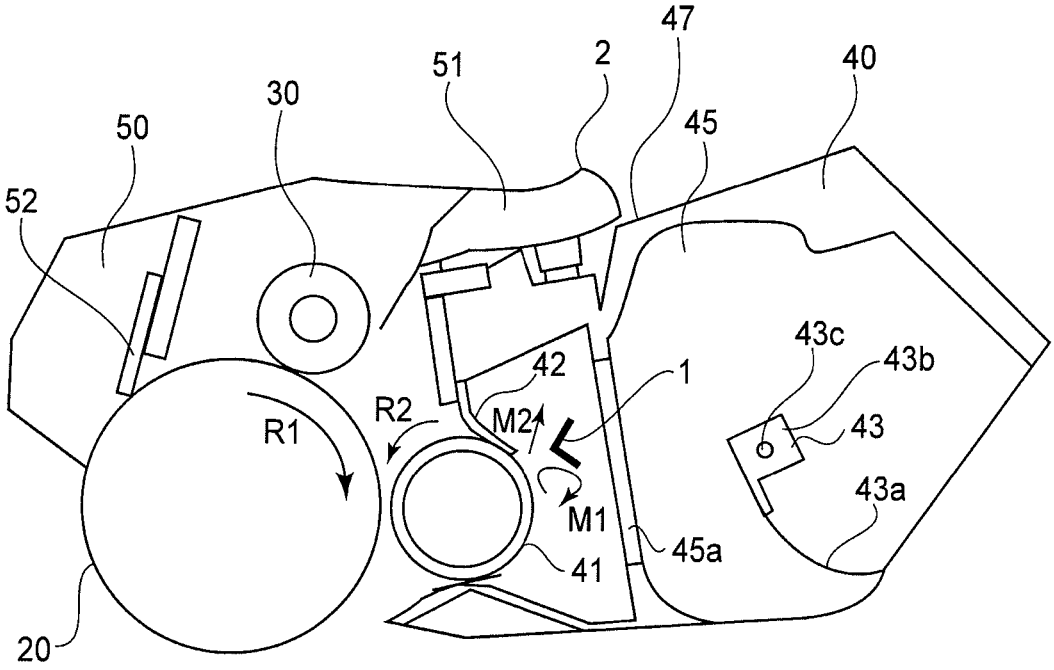
FIG. 3 is a sectional view of a process cartridge according to the present invention.
Figure 4:
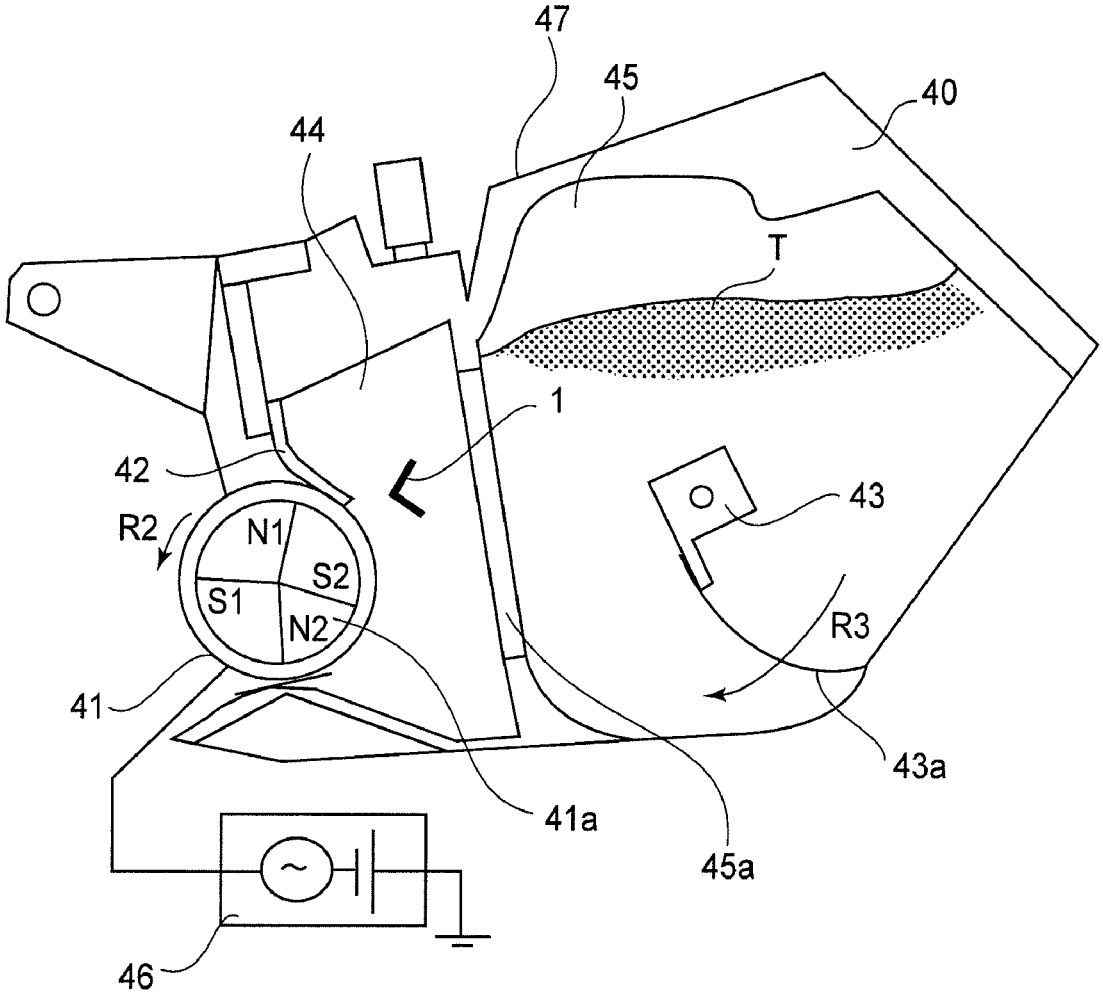
FIG. 4 is a sectional view of the developing device in the process cartridge according to the present invention.

Next, a structure of the process cartridge 2 will be briefly described. FIG. 3 is a schematic sectional view showing the process cartridge 2 in this embodiment. FIG. 4 is a schematic sectional view showing a developing device 40 in the process cartridge 2 in this embodiment.

Referring to FIGS. 3 and 4, the process cartridge 2 integrally includes a photosensitive drum 20 as the image bearing member and the process means acting on the photosensitive drum 20. In this embodiment, a charging device (charging means) 30, the developing device (developing means) 40 and a cleaning device (cleaning means) 50 which are the process means are integrally accommodated. The photosensitive drum 20 and the charging device 30 are attached to a frame 51 of the cleaning device 50.

(Image Forming Process)

Next, an image forming operation will be described briefly with reference to FIG. 5.

On the basis of a print start signal, the photosensitive drum 20 is rotationally driven in a direction indicated by an arrow R1. The charging device 30 supplied with a bias voltage contacts an outer circumferential surface of the photosensitive drum 20. By this charging device 30, the surface of the photosensitive drum 20 is electrically charged uniformly.

From the laser scanner unit 3, laser light L which has been modulated correspondingly to a time-serial electric digital pixel (picture) signal of image formation is output. Further, the laser light L enters the inside of the process cartridge 2 through an exposure window (not shown) provided at an upper portion of the process cartridge 2, so that the surface of the photosensitive drum 20 is subjected to scanning exposure.

As a result, an electrostatic image corresponding to the image information is formed on the outer circumferential surface of the photosensitive drum 20. The electrostatic image is developed into a toner image with a developer (toner), on a developing sleeve 41 as the developer carrying member, which has been subjected to triboelectric charge important and layer thickness regulation by a developing blade 42 as a developer layer thickness regulating member.

On the other hand, in synchronism with output timing of the laser light L, the sheet P as the recording material is fed and conveyed from the sheet tray 4 by the pick-up roller 5, the sheet feeding roller (not shown) and the sheet conveying roller pair (not shown). The sheet P passes through the transfer guide 6 and is supplied to a transfer position between the photosensitive drum 20 and the transfer charging roller 7 while being properly timed to the toner image. At this transfer position, the toner image is successively transferred from the photosensitive drum 20 onto the sheet P.

The sheet plane on which the toner image has been transferred is separated from the photosensitive drum 20 and is conveyed into the fixing device 9 along the conveying guide 8. The toner image is subjected to fixing under application of heating and pressure in a nip between a fixing roller 9*a* and a pressing roller 9*b* which constitute the fixing device 9, thus being fixed on the sheet P. The sheet P which has been subjected to the fixation of the toner image is conveyed to the sheet discharging roller pair 10 and is discharged on the sheet discharging tray 11.

On the other hand, the photosensitive drum 20 after the transfer is subjected to removal of residual toner remaining on the surface thereof by a cleaning blade 52 of the cleaning device 50 and then is subjected to image formation starting from the charging again.

(Developing Device)

Here, the developing device 40 in the process cartridge 2 will be described in detail. As shown in FIG. 4, the developing device 40 includes a developing container 47 for accommodating toner T, the developing sleeve 41 which is the developer carrying member, the developing blade 42 which is the developer layer thickness regulating member, a toner feeding member 43, a circulation changing member 1, and the like.

Incidentally, the developing container 47 is constituted by a toner chamber 45 and a developing chamber 44 which are partitioned by a toner supply opening 45*a*. In the toner chamber 45, the toner feeding member 43 is provided. In the developing chamber 44, the developing sleeve 41 is provided. The toner in the toner chamber 45 is fed into the developing chamber 44 through the toner supply opening 45*a* by rotation of the toner feeding member 43.

(Developing Sleeve and Developing Blade)

The developing sleeve 41 in this embodiment is a rotatable image carrying member for carrying and feeding the developer (toner) on its surface and is rotationally driven in a direction indicated by an arrow R2. In this embodiment, the developing sleeve 41 was formed by coating a bare tube having a diameter of 16 mm with a coating liquid containing carbon black particles or the like dispersed therein and then by drying the coating liquid to have a surface roughness Ra of 1.4 μm.

The developing blade 42 is the developer layer thickness regulating member for defining a toner amount (toner layer thickness) on a peripheral surface of the developing sleeve 41. The developing blade 42 is prepared by bonding urethane rubber to a supporting metal plate and contacts the developing sleeve 41, in a direction (counter direction) in which the developing blade 42 is disposed against the rotation of the developing sleeve 41, at a predetermined pressure (30 gf/cm$^2$ in this embodiment). In this embodiment, the developing blade 42 having a uniform thickness was used.

To the developing sleeve 41, from a developing bias voltage source 46, a developing bias in the form of a DC voltage biased with an AC voltage is applied. The photosensitive drum 20 is grounded. In an area in which the photosensitive drum 20 and the developing sleeve 41 oppose each other, an electric field is generated, so that the latent image formed on the surface of the photosensitive drum 20 is developed into the toner image with the above-described charged toner.

(Magnet Roller)

Inside the developing sleeve 41, four developing magnet rollers 41*a* having a magnetic pole distribution N1, S1, N2, and S2 are provided with respect to a circumferential direction of the developing sleeve 41. In the case where a rotation center of the developing sleeve 41 is 0, a line drawn from the rotation center O of the developing sleeve 41 in a direction perpendicular to the gravitational direction is $A_O$, and the rotational direction of the developing sleeve 41 is taken as positive, a toner feeding pole S2 was located so as to form an angle of 5 degrees from the line $A_O$ and had a magnetic force of 800 gauss. The developing sleeve 41 is rotated about the rotation center O as a rotational axis thereof.

(Circulation Changing Member)

The circulation changing member 1 is provided at a position in which the circulation changing member 1 opposes the developing sleeve 41 and the developing blade 42 and is located in the neighborhood of the developing sleeve 41 and the developing blade 42. The circulation changing member 1 changes circulation of the toner present, in the developing chamber 44, in the neighborhood of the developing sleeve 41. Herein, the change of the toner circulation means that the toner circulation when the circulation changing member 1 is disposed is changed compared with that in a state in which the circulation changing member 1 is not disposed. In this embodiment, as the circulation changing member 1, an L-shaped circulation changing member prepared by bending a flat plate in the middle is disposed inside the developing container 47 so as to extend in a longitudinal direction of the developing container 47 (i.e., a direction of the rotational axis of the developing sleeve 41). That is, the circulation changing member 1 has such a cross section that it is bent in the L-shape in a plane perpendicular to the developing sleeve rotational axis. Further, the circulation changing member 1 is provided in the plane so as to create a gap between itself and the developing sleeve 41 and a gap between itself and the entire inner sheet 47*a* of the developing container 47. The reason why the gaps are created is that the circulation of the developer is effected by using the gaps. The bent portion has a bent point X and the circulation changing member 1 is disposed so that the bent point X is closest to the sectional view of the developing sleeve 41. The circulation changing member 1 (bent portion) also has an upper end a and a lower end b between which the bent point X is located.

In this embodiment, the position of the circulation changing member 1 relative to the developing sleeve 41 is set as follows. As described above, the developing sleeve 41 has the rotation center O, and the line $A_O$ is drawn from the rotation center O in the direction perpendicular to the gravitation direction. A line drawn from the rotation center O of the developing sleeve 41 to the bent point X of the circulation changing member 1 closest to the surface of the developing sleeve 41 is $B_O$. In the case where the rotational direction of the developing sleeve 41 is taken as positive, the position of the circulation changing member 1 relative to the developing sleeve 41 is set so that an inclination of the line $B_O$ from the line $A_O$ is a predetermined angle $\alpha$. Further, the minimum distance between the developing sleeve 41 and the circulation changing member 1 is taken as d, and the minimum distance d is set in the range from 1 mm to 10 mm, i.e., $1\ (\text{mm}) \leqq d \leqq 10\ (\text{mm})$.

Incidentally, in this embodiment, as the circulation changing member for changing the toner circulation in the neighborhood of the developing sleeve in the developing container, the L-shaped circulation changing member which is a means for obtaining a high-quality image free from an occurrence of the negative ghost is described but the present invention is not limited thereto. For example, it is also possible to employ a constitution in which another means is provided as the circulation changing member in such a manner that one of plate antennas which is a developer detecting means for detecting the amount of the developer in the developing device is provided so as to be utilized as the circulation changing member. Further, the shape of the circulation changing member 1 is not limited to the above-described L-shape.

(Toner Feeding Member)

The toner feeding member 43 is a rotatable developer feeding member for feeding the toner accommodated in the toner chamber 45 toward the developing sleeve 41. The toner feeding member 43 includes a rotation shaft 43*b* and an elastic sheet (elastic feeding portion) 43*a* having a base end portion provided on the rotation shaft 43*b* and having a free end at an opposite end portion, and is rotationally driven about the rotational axis 43*c* in a direction indicated by an arrow R3. In this embodiment, as the elastic sheet 43*a*, a 100 μm-thick sheet of PPS was used. Further, the toner feeding member 43 is provided so that the circulation changing member 1 is located in a rotation area thereof. As a result, the toner between the developing sleeve 41 and the circulation changing member 1 is pushed out by the toner feeding member 43 in its rotational direction, so that the toner can be replaced with another toner. In FIG. 1, a broken line 43*d* represents a rotational movement locus of the end of the elastic feeding portion 43*a* when the elastic feeding portion 43*a* is assumed that it is rotated about the rotational axis 43*c* in a state in which the elastic feeding portion 43*a* does not contact the inner wall of the developing container 47 and the circulation changing member 1 (i.e., in a state in which there is no deformation by contact). Further, a circular area defined by this rotational movement locus is referred to as a maximum rotation area, and the circulation changing member 1 is disposed within the maximum rotation area.

EXPERIMENT 1

Hereinbelow, an image density and pushing-up (raising) of the toner between the developing sleeve 41 and the circulation changing member 1 in the case where the image was formed until the toner approached its end of the use in the high temperature/high humidity environment (32.5° C./80% RH) while changing distances Y1 and Y2 shown in FIG. 1 were investigated. The distance Y1 is a distance from the rotational axis 43*c* of the toner feeding member 43 to the position of the circulation changing member 1 closest to the developing sleeve 41 (the bent point X in this embodiment). The distance Y2 is a distance from the rotational axis 43*c* of the toner feeding member 43 to the end of the elastic sheet 43*a* in the state in which the elastic sheet 43*a* does not contact the inner wall of the developing container 47 and the circulation changing member 1 (in the state in which there is no deformation by contact). The image density and the pushing-up of the toner between the developing sleeve 41 and the circulation changing member 1 were investigated. A result is shown in Table 1 appearing hereinafter.

Figure 2:
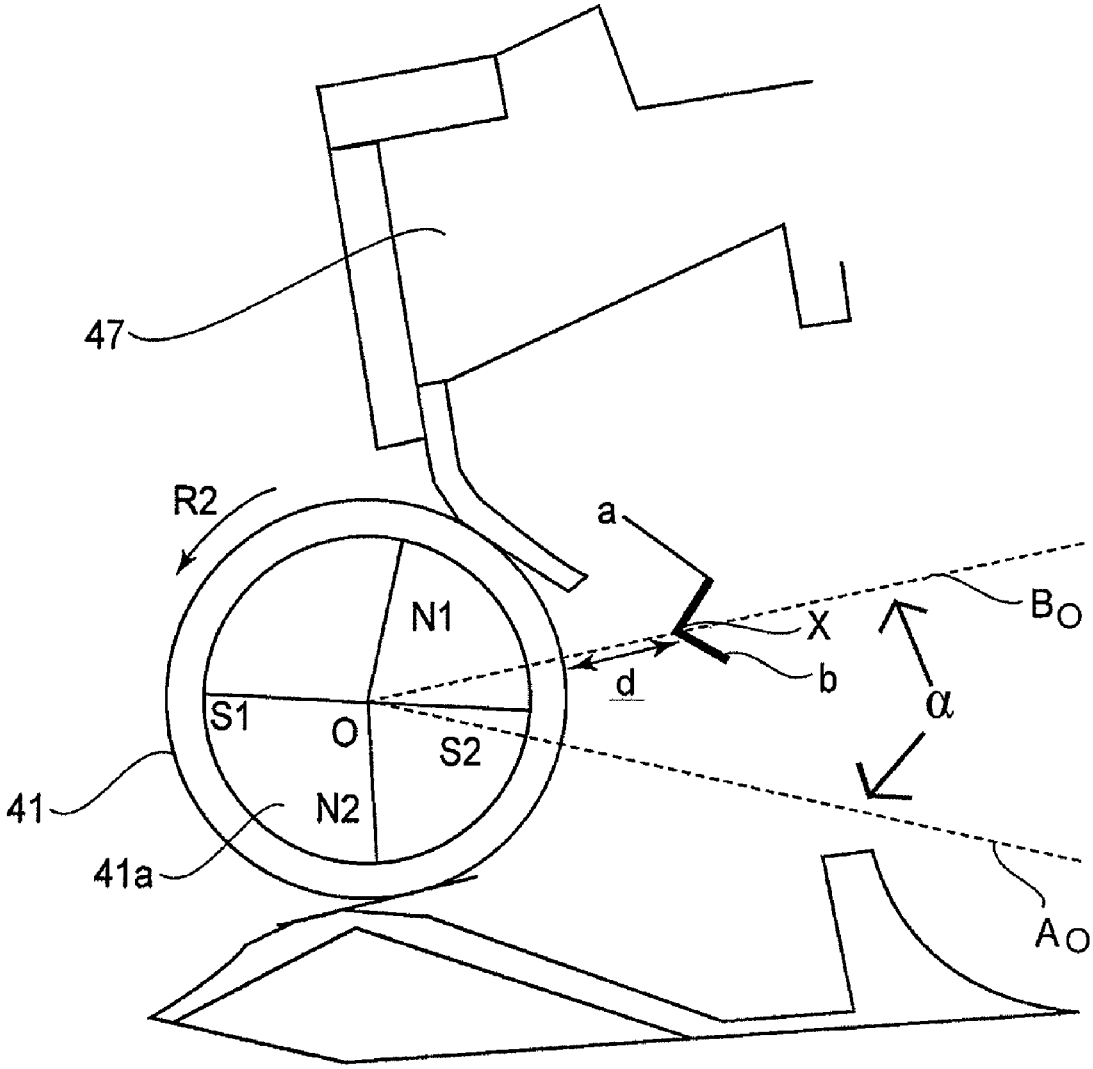

The position of the circulation changing member 1 in this experiment will be described with reference to FIG. 2 showing the case where the circulation changing member 1 is mounted in the main assembly of the image forming apparatus.

In this case, as the circulation changing member, a 6 mm-thick plate bent in the L-shape by being bent in the middle of the plate at right angles is used. The circulation changing member is disposed so that the bent point X thereof is closest to the sectional view of the developing sleeve 41.

Specifically, in the case where the rotational direction of the developing sleeve 41 is taken as positive, the circulation changing member 1 is disposed relative to the developing sleeve 41 at the position in which the inclination angle α of the line $B_O$ from the line $A_O$ is 25 degrees and the minimum distance C between the developing sleeve 41 and the circulation changing member 1 is 5 mm. Further, the upper end a is located at a position of 3 mm from the bent point X of the circulation changing member 1 in a direction of 45 degrees with respect to the line $B_O$, and the lower end b is located at a position of 3 mm from the bent point X in a direction of −45 degrees with respect to the line $B_O$.

In this experiment, by using a process cartridge having a printable page (sheet) number of 13,000 sheets, a solid black image with a print ratio of 100% at the time of printing on 12,800 sheets was printed on 12,800 sheets in the neighborhood of the end of use, so that the image density was checked. The image density was measured by using a densitometer ("RD-918" mfd. by Macbeth Co., Ltd.). Evaluation of the image density is made in a manner such that the image density of 1.3 or more is "A", the image density of 1.2 or more and less than 1.3 is "B", and the image density of less than 1.2 is "C". The pushing-up of the toner in the rotational direction of the toner feeding member 43 (i.e., the toner circulation in the arrow R2 direction) was judged by directly observing with eyes the process cartridge through a hole bored therein at its upper portion after the printing on 12,800 sheets while idling the process cartridge with the use of an idling machine. When the state of the toner pushed up from the gap between the developing sleeve and the circulation changing member was observed, the pushing-up was judged as "A", when the toner pushing-up state was somewhat observed, the pushing-up was judged as "B", and when the toner pushing-up state was not observed, the pushing-up was judged as "C". A speed of the idling was equal to the process speed (209 mm/sec) when the process cartridge was mounted in the image forming apparatus main assembly. The result is shown in Table 1.

TABLE 1

| Y2 − Y1 (mm) | Image density | Toner pushing-up |
|---|---|---|
| −2 | C | C |
| −1 | C | C |
| −0.5 | C | C |
| 0 | B | B |
| 0.5 | A | A |
| 1 | A | A |
| 2 | A | A |
| 3 | A | A |

Under a condition of (Y2−Y1)<0 (mm), in the case where the image was printed (formed) until the neighborhood of the end of use in the high temperature/high humidity environment, the levels of the image density and the pushing-up were both "C". That is, under the condition of (Y2−Y1)<0 (mm), in the case where the toner is consumed and decreased in amount, the toner pushing-up between the developing sleeve 41 and the circulation changing member 1 by the toner feeding member 43 cannot be effected. For this reason, it seems that the lowering in toner flowability and the toner deterioration proceed and the circulation of the toner in the arrow M2 direction shown in FIG. 3 is slowed down and thus the toner is caught in a vicious cycle of the further lowering in toner flowability and the further toner deterioration, so that the image density is lowered.

On the other hand, under the condition of (Y2−Y1)>0 (mm), in the case where the image was printed (formed) until the neighborhood of the end of use in the high temperature/high humidity environment, the levels of the image density and the pushing-up were both "A". That is, under the condition of (Y2−Y1)>0 (mm), even when the toner is consumed and decreased in amount, the toner pushing-up between the developing sleeve 41 and the circulation changing member 1 by the toner feeding member 43 was effected. For this reason, even when the toner in the developing container passes through the NE portion of the developing blade many times and was lowered in flowability, the toner between the developing sleeve and the circulation changing member was forcedly pushed up in the arrow M2 direction by the toner feeding member. As a result, the same toner is not subjected to long-time circulation (rubbing with the developing sleeve) in the arrow M1 direction. For this reason, the external additive of the toner is not buried in the base material, so that it is possible to suppress the lowering in toner flowability and the toner deterioration. Therefore, it seems that the lowering in image density was able to be suppressed.

Incidentally, under the condition of (Y2−Y1)=0 (mm), in the case where the image is printed until the neighborhood of the end of use in the high temperature/high humidity environment, the levels of the image density and the toner pushing-up were both "B". Under the condition of (Y2−Y1)=0 (mm), when the toner pushing-up state is observed, the toner pushing-up was able to be observed with eyes although a degree thereof was lower than that under the condition of (Y2−Y1)>0 (mm). For that reason, it seems that a slight effect on the image density was achieved even under the condition of (Y2−Y1)=0 (mm).

As described above, by providing the toner feeding member 43 so that the circulation changing member 1 is located in the rotation arrow of the toner feeding member 43, the toner between the developing sleeve 41 and the circulation changing member 1 is pushed out by the toner feeding member 43 in its rotation direction, thus being replaced with another toner. For that reason, even in the case where the toner is decreased in amount and flowability, the same toner is prevented from circulating between the developing sleeve and the circulation changing member for a long time. As a result, further toner flowability lowering and further toner deterioration can be prevented and the lowering in image density can be suppressed, so that it is possible to obtain an image with a stable image density until the neighborhood of the end of use.

Second Embodiment

In this embodiment, by employing the developing device and the experimental condition similar to those in Experiment 1, the negative ghost and the image density when the minimum distance d was changed in addition to the distance (Y2−Y1) were investigated. The image density was judged in the same manner as in Experiment 1, i.e., "A" represents the image density of 1.3 or more, "B" represents the image density of 1.2 or more and less than 1.3, and "C" represents the image density of less than 1.2. With respect to the negative ghost, "A" represents that the negative ghost did not occurred and "B" represents that the negative ghost occurred; A result is shown in Table 2.

TABLE 2

| Y2 – Y1 (mm) | Evaluation Item | C (mm) 1 | 3 | 5 | 7 | 10 | 12 |
|---|---|---|---|---|---|---|---|
| −0.5 | I.D. *1 | C | C | C | C | B | A |
| | N.G. *2 | A | A | A | A | A | B |
| 0 | I.D. | B | B | B | B | A | A |
| | N.G. | A | A | A | A | A | B |
| 1 | I.D. | A | A | A | A | A | A |
| | N.G. | A | A | A | A | A | B |

*1: "I.D." is the image density.
*2: "N.G." is the negative ghost.

As shown in Table 2, under the conditions of (Y2−Y1)=−1.5 mm, 0 mm and 0.5 mm, when the minimum distance d was 12 mm, the negative ghost occurred although the image density was not lowered. This may be attributable to the toner circulation in the arrow M2 direction is increased, while the toner circulation in the arrow M1 direction is decreased.

When the distance (Y2−Y1) was −0.5 mm and the minimum distance d was in the range from 1 mm to 10 mm ($1 \leqq d \leqq 10$), the negative ghost did not occur but the image density was lowered. This may be attributable to the following phenomenon. That is, the toner in the neighborhood of the developing sleeve cannot be stirred, so that the toner between the developing sleeve and the circulation changing member cannot be pushed out above the upper portion of the circulation changing member. As a result, the toner between the developing sleeve and the circulation changing member cannot be replaced within another toner in the developing container, so that the toner flowability lowering and the toner deterioration proceed and thus the image density is lowered.

On the other hand, when the distance (Y2−Y1) was 0.5 mm and the minimum distance d was in the range from 1 mm to 10 mm, the image density was not lowered. Under this condition, the toner feeding member 43 is extended by 1 mm when compared with the case of the distance (Y2−Y1) is −0.5 mm. As a result, it seems that the toner between the developing sleeve and the circulation changing member can be pushed out above the upper portion of the circulation, changing member. Thus, it seems that the toner between the developing sleeve and the circulation changing member is replaced with another toner in the developing container and therefore the toner flowability lowering and the toner deterioration do not proceed and thus the image density is not lowered.

Further, when the distance (Y2−Y1) was 0 mm and the minimum distance d was in the range from 1 mm to 10 mm, the image density was not lowered when compared with the case of the distance (Y2−Y1) of −0.5 mm. Under this condition, compared with the case of the distance (Y2−Y1) of −0.5 mm, the toner feeding member 43 is extended by 0.5 mm. As a result, it seems that the toner in the neighborhood of the developing sleeve can be stirred and therefore the toner between the developing sleeve and the circulation changing member can be pushed out above the upper portion of the circulation changing member but an amount thereof is insufficient. For that reason, it seems that the toner between the developing sleeve and the circulation changing member is not sufficiently replaced with another toner in the developing container and therefore the long-time rubbing of the same toner is slightly suppressed and thus the toner flowability lowering and the toner deterioration and prevented.

Incidentally, when the minimum distance d is less than 1 mm, a vertical stripe occurred. This may be attributable to toner agglomeration by speed down of the toner circulation due to an excessively small gap between the developing sleeve and the circulation changing member.

As described above, by taking into consideration the minimum distance between the developing sleeve 41 and the circulation changing member 1 in addition to the disposition place of the toner feeding member 43 relative to the circulation changing member 1, the lowering in flowability of the toner and the deterioration of the toner can be further suppressed, so that the image density lowering can be suppressed and it is possible to obtain an image with a stable image density until the neighborhood of the end of use.

Other Embodiments

In the above-described embodiments, as the cartridge detachably mountable to the image forming apparatus main assembly, the process cartridge integrally including the photosensitive drum, and the process means acting on the photosensitive drum, inclusive of the charging means, the developing means and the cleaning means is described but the present invention is not limited thereto. It is also possible to use other process cartridges such as a process cartridge integrally including the photosensitive drum, the developing means, and either one of the charging means and the cleaning means.

Further, the cartridge is not limited to the process cartridge integrally including the photosensitive drum and the process means but may also be the above-described developing cartridge including the developing device. The developing cartridge is prepared by integrally supporting the developing sleeve, the circulation changing member and the toner feeding member in the developing device and is detachably mountable to the image forming apparatus main assembly. Further, the present invention is also effective even when the developing device is provided in the image forming apparatus main assembly, not of the cartridge type in which the cartridge can be easily exchanged by the user.

Further, in the above-described embodiments, the printer is described as the image forming apparatus but the present invention is not limited thereto. The present invention is also applicable to other image forming apparatuses such as a copying machine, a facsimile machine, a multi-function machine having functions of these machines, and the like machine. A similar effect can be obtained by applying the present invention to the developing device used in these image forming apparatuses or to the cartridge including the developing device.

While the invention has been described with reference to the structures disclosed herein, it is not confined to the details set forth and this application is intended to cover such modifications or changes as may come within the purpose of the improvements or the scope of the following claims.

This application claims priority from Japanese Patent Application No. 183064/2009 filed Aug. 6, 2009, which is hereby incorporated by reference.

What is claimed is:

1. A developing device comprising:

a developing container for accommodating a developer;

a developer carrying member, provided rotatably in said developing container, for carrying and feeding the developer to develop an electrostatic image;

a developer feeding member, including an elastic feeding portion and being rotatably provided in said developing container, for feeding the developer in said developing container toward said developer carrying member; and a circulation changing member for changing circulation of the developer in the neighborhood of said developer carrying member, wherein in a plane perpendicular to a rotational axis of said developer carrying member, said circulation changing member being provided in a maximum rotation area of said developer feeding member so as to create a gap between itself and an entire inner surface of said developing container and a gap between itself and said developer carrying member, wherein said circulation changing member has a bent cross-sectional shape in the plane, and wherein said circulation changing member is disposed in an attitude such that a bent portion of the bent cross-sectional shape is closest to said developer carrying member.

2. A developing device comprising:

a developing container for accommodating a developer;

a developer carrying member, provided rotatably in said developing container, for carrying and feeding the developer to develop an electrostatic image;

a developer feeding member, including an elastic feeding portion and being rotatably provided in said developing container, for feeding the developer in said developing container toward said developer carrying member; and a circulation changing member for changing circulation of the developer in the neighborhood of said developer carrying member, wherein in a plane perpendicular to a rotational axis of said developer carrying member, said circulation changing member being provided in a maximum rotation area of said developer feeding member so as to create a gap between itself and an entire inner surface of said developing container and a gap between itself and said developer carrying member, wherein when a distance from the rotational axis of said developer feeding member to a farthest position of said circulation changing member with respect to the rotational axis is Y1 (mm) and a distance from the rotational axis of said developer feeding member to an end of said elastic feeding portion is Y2 (mm), Y1 and Y2 satisfy the following relationship:

$$Y2-Y1>0.$$

3. A device according to claim 2, wherein when a minimum distance between a surface of said developer carrying member and said circulation changing member is C (mm), C satisfies the following relationship:

$$1 \leqq C \leqq 10.$$

4. A cartridge detachably mountable to a main assembly of an image forming apparatus, said cartridge comprising:

a developing container for accommodating a developer;

a developer carrying member, provided rotatably in said developing container, for carrying and feeding the developer to develop an electrostatic image;

a developer feeding member, including an elastic feeding portion and being rotatably provided in said developing container, for feeding the developer in said developing container toward said developer carrying member; and a circulation changing member for changing circulation of the developer in the neighborhood of said developer carrying member, wherein in a plane perpendicular to a rotational axis of said developer carrying member, said circulation changing member being provided in a maximum rotation area of said developer feeding member so as to create a gap between itself and an entire inner surface of said developing container and a gap between itself and said developer carrying member, wherein said circulation changing member has a bent cross-sectional shape in the plane, and wherein said circulation changing member is disposed in an attitude such that a bent portion of the bent cross-sectional shape is closest to said developer carrying member.

5. A cartridge according to claim 4, further comprising an image bearing member for forming the electrostatic image.

6. A cartridge detachably mountable to a main assembly of an image forming apparatus, said cartridge comprising:

a developing container for accommodating a developer;

a developer carrying member, provided rotatably in said developing container, for carrying and feeding the developer to develop an electrostatic image;

a developer feeding member, including an elastic feeding portion and being rotatably provided in said developing container, for feeding the developer in said developing container toward said developer carrying member; and a circulation changing member for changing circulation of the developer in the neighborhood of said developer carrying member, wherein in a plane perpendicular to a rotational axis of said developer carrying member, said circulation changing member being provided in a maximum rotation area of said developer feeding member so as to create a gap between itself and an entire inner surface of said developing container and a gap between itself and said developer carrying member, wherein when a distance from the rotational axis of said developer feeding member to a farthest position of said circulation changing member with respect to the rotational axis is Y1 (mm) and a distance from the rotational axis of said developer feeding member to an end of said elastic feeding portion is Y2 (mm), Y1 and Y2 satisfy the following relationship:

$$Y2-Y1>0.$$

7. A cartridge according to claim 6, wherein when a minimum distance between a surface of said developer carrying member and said circulation changing member is C (mm), C satisfies the following relationship:

$$1 \leqq C \leqq 10.$$

8. A cartridge according to claim 6, further comprising an image bearing member for forming the electrostatic image.

9. A developing device comprising:

a developing container for accommodating a developer;

a developer carrying member, provided rotatably in said developing container, for carrying and feeding the developer to develop an electrostatic image;

a developer feeding member, including an elastic feeding portion and being rotatably provided in said developing container, for feeding the developer in said developing container toward said developer carrying member; and a circulation changing member for changing circulation of the developer in said developing container, wherein in a plane perpendicular to a rotational axis of said developer carrying member, said circulation changing member being provided in a maximum rotation area of said developer feeding member so as to create a gap between itself and an entire inner surface of said developing container and a gap between itself and said developer carrying member, wherein said developing container includes a first chamber in which said developer carrying member is located, a second chamber in which a rotation center of said developer feeding member is located, and an opening capable of permitting communication between said first chamber and said second chamber and movement of the developer from said second chamber to said first chamber, and wherein said circulation changing member is located in said first chamber.

10. A cartridge detachably mountable to a main assembly of an image forming apparatus, said cartridge comprising:

a developing container for accommodating a developer;

a developer carrying member, provided rotatably in said developing container, for carrying and feeding the developer to develop an electrostatic image;

a developer feeding member, including an elastic feeding portion and being rotatably provided in said developing container, for feeding the developer in said developing container toward said developer carrying member; and a circulation changing member for changing circulation of the developer in said developing container, wherein in a plane perpendicular to a rotational axis of said developer carrying member, said circulation changing member being provided in a maximum rotation area of said developer feeding member so as to create a gap between itself and an entire inner surface of said developing container and a gap between itself and said developer carrying member, wherein said developing container includes a first chamber in which said developer carrying member is located, a second chamber in which a rotation center of said developer feeding member is located, and an opening capable of permitting communication between said first chamber and said second chamber and movement of the developer from said second chamber to said first chamber, and wherein said circulation changing member is located in said first chamber.

11. A cartridge according to claim 10, further comprising an image bearing member for forming the electrostatic image.

* * * * *